US009270052B1

(12) United States Patent
Martin et al.

(10) Patent No.: US 9,270,052 B1
(45) Date of Patent: Feb. 23, 2016

(54) PASS-THROUGH CONNECTOR SYSTEM

(71) Applicant: Tyco Electronics Corporation, Berwyn, PA (US)

(72) Inventors: Galen M. Martin, Camp Hill, PA (US); Matthew Bryan Hitchcock, Harrisburg, PA (US); Andrew Jacob Vasbinder, Boiling Springs, PA (US); Randy Gray Simmons, Winston Salem, NC (US); Tracy Everette Wilson, Summerfield, NC (US); Hoy S. Beck, Jr., Lexington, NC (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/675,033

(22) Filed: Mar. 31, 2015

(51) Int. Cl.
*H01R 13/64* (2006.01)
*H01R 13/631* (2006.01)
*H01R 13/52* (2006.01)

(52) U.S. Cl.
CPC ..... *H01R 13/6315* (2013.01); *H01R 13/5202* (2013.01)

(58) Field of Classification Search
CPC ..... H01R 13/6315; H01R 13/631; H01R 13/748; H01R 13/74; H01R 13/629
USPC ..... 439/247–248, 339, 545, 465, 557, 439/552–554, 544, 310, 372, 347, 567, 562
See application file for complete search history.

(56) References Cited

U.S. PATENT DOCUMENTS 5,127,852 A * 7/1992 Cravens ..... H01R 13/745 439/545
6,312,285 B1 * 11/2001 Berg ..... H01R 13/74 439/545
8,353,720 B2 * 1/2013 Sun ..... H01R 13/748 439/545
8,672,708 B2 * 3/2014 Ritter ..... H01R 13/514 439/247

* cited by examiner

*Primary Examiner* — Edwin A. Leon

(57) ABSTRACT

A pass-through connector system is provided that includes a receptacle assembly and a pass-through connector. The receptacle assembly has a mounting ear at least proximate to a mounting end. The mounting ear defines an aperture therethrough that receives a fastener to mount the receptacle assembly to a substrate. A diameter of the aperture of the mounting ear is greater than an outer diameter of the fastener such that a gap is formed between the mounting ear and the fastener. The pass-through connector extends through a window in a panel that at least partially surrounds the substrate. The pass-through connector has a shroud at a plug end that defines an opening to a cavity. The receptacle assembly is floatable radially within the gap relative to the fastener to allow the shroud to guide the receptacle assembly into alignment with the cavity of the pass-through connector during mating.

20 Claims, 6 Drawing Sheets

PASS-THROUGH CONNECTOR SYSTEM

BACKGROUND OF THE INVENTION

The subject matter herein relates generally to connector systems that provide a signal path through a panel.

Some known electrical connectors are pass-through connectors that may be used to provide an electrical conductive path through a panel. The panel may be a cover for an electrical device, a machine, or another structure. In an automotive context, the device, machine, or structure may be an engine or a transmission, and the panel may be an engine cover or a transmission cover, respectively. The panel provides protection for the device, machine, structure, and/or the surrounding environment, such as from debris, contaminants, liquids, impact forces, harsh temperatures, or pressures. The panel is typically mounted to (or is otherwise fixed in place relative to) the device, machine, or structure. Yet, sensors and other electrical devices may be located between the panel and the device, machine, or structure. In order to convey signals between the electrical devices within the panel and processors and other devices outside of the panel, conductive paths must be established that extend through an opening in the panel.

To simplify the passage through the panel versus feeding individual wires through one or more openings in the panel, multiple wires from various internal electrical devices may be terminated to a header connector that is mounted within the panel, on or near the device, machine, or structure. A pass-through connector may be configured to extend through the opening in the panel to mate to the header connector which provides the signal paths across the panel. However, the panel is typically separately mounted to the device, machine, or structure than the header connector, which may cause the header connector to be misaligned relative to the opening of the panel. Since the pass-through connector extends through the opening, the pass-through connector may not align correctly with the header connector, which results in a missed or faulty connection, damage to one or both of the connectors, and/or leaks at the opening that may allow the undesired transmission of contaminants, liquids, debris, pressure, heat, and the like, through the panel. In addition, the header connector is located between the panel and the device, machine, or structure, so the pass-through connector mates blindly to the header connector as the pass-through connector is loaded from outside of the panel through the opening. Thus, it is difficult to properly mate the header connector to the pass-through connector to provide signal paths across the panel because it is difficult to align the opening of the panel with the header connector, and it is difficult to blindly connect the pass-through connector to the header connector. A need remains for a pass-through connector system that provides better alignment and sealing between the connectors and the opening in the panel.

BRIEF DESCRIPTION OF THE INVENTION

In an embodiment, a pass-through connector system includes a receptacle assembly and a pass-through connector. The receptacle assembly extends between a mating end and a mounting end. The receptacle assembly has a mounting ear at least proximate to the mounting end. The mounting ear defines an aperture therethrough. The receptacle assembly further includes a fastener received in the aperture. The fastener is configured to be coupled to a substrate to mount the receptacle assembly to the substrate. A diameter of the aperture of the mounting ear is greater than an outer diameter of the fastener such that a gap is formed between an inner surface of the mounting ear and an outer surface of the fastener. The pass-through connector has a plug end configured to extend through a window in a panel that at least partially surrounds the substrate to mate to the mating end of the receptacle assembly. The pass-through connector defines a cavity that has an opening at the plug end. The pass-through connector has a shroud at the plug end that guides the mating end of the receptacle assembly through the opening into the cavity. The receptacle assembly is floatable radially within the gap relative to the fastener to allow the shroud of the pass-through connector to move the receptacle assembly into alignment with the cavity of the pass-through connector during mating.

In an embodiment, a pass-through connector system includes a panel, a receptacle assembly, and a pass-through connector. The panel is coupled to and at least partially surrounds a substrate. The panel is spaced apart from the substrate and defines a covered space therebetween. The panel defines a window through the panel into the covered space. The receptacle assembly is mounted to the substrate and located in the covered space. The receptacle assembly extends between a mating end and a mounting end. The receptacle assembly has a mounting ear at least proximate to the mounting end. The mounting ear defines an aperture therethrough. The receptacle assembly further includes a fastener received in the aperture that is coupled to the substrate to mount the receptacle assembly to the substrate. A diameter of the aperture of the mounting ear is greater than an outer diameter of the fastener such that a gap is formed between an inner surface of the mounting ear and an outer surface of the fastener. The receptacle assembly is floatable radially within the gap relative to the fastener. The pass-through connector extends through the window of the panel. The pass-through connector has a plug end within the covered space that is mated to the mating end of the receptacle assembly. The pass-through connector defines a cavity that has an opening at the plug end. The pass-through connector has a shroud at the plug end that guides the mating end of the floatable receptacle assembly through the opening into the cavity during mating.

DETAILED DESCRIPTION OF THE INVENTION

Figure 1:
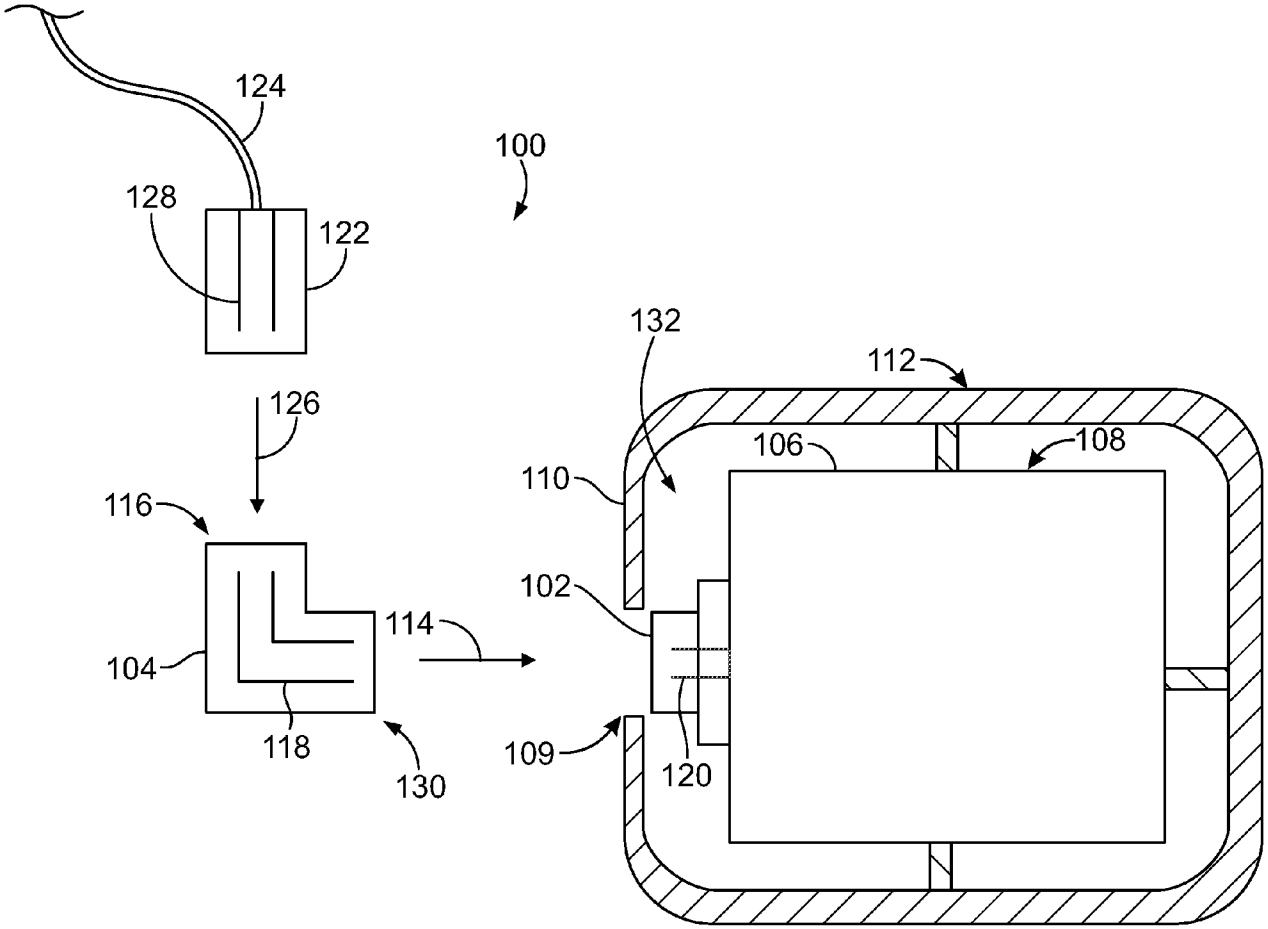
FIG. 1 is a schematic block diagram of a pass-through connector system formed in accordance with an embodiment.

FIG. 1 is a schematic block diagram of a pass-through connector system 100 formed in accordance with an embodiment. The pass-through connector system 100 has a receptacle assembly 102 configured to couple with a pass-through connector 104. In one or more embodiments, the receptacle assembly 102 may be mounted to a substrate 106. The receptacle assembly 102 may be a header connector assembly. The substrate 106 may be a structural component of a device or machine 108. For example, the substrate 106 may be a chassis, a block, a frame, a case, and/or the like. The device or machine 108 may be or include a motor, an engine, a transmission, a computer, a sensor, and/or the like. In an example, the device 108 may be an engine, and the substrate 106 is an engine case or block.

In one or more embodiments, the pass-through connector 104 is configured to extend through a window 109 in a panel 110. The panel 110 may be part of a cover 112 that at least partially surrounds the substrate 106 of the device 108. The cover 112 may protect the device 108 from encountering debris, liquids, and other contaminants external to the cover 112. The cover 112 also may be used as a barrier to maintain internal conditions (e.g., temperature, pressure, gases) within the cover 112 that may differ from ambient external conditions. The cover 112 may be mounted or coupled to the substrate 106. Optionally, the cover 112 may be coupled to the substrate 106 separately or independently from the mounting of the receptacle assembly 102 to the substrate 106. The cover 112 is shown in cross-section in FIG. 1. It should be noted that FIG. 1 is schematic in nature and intended by way of example. In various embodiments, various aspects or structures may be omitted, modified, or added. Further, various devices, systems, or other aspects may be combined. For example, the cover 112 optionally may not surround an entire periphery of the device 108 as is shown in FIG. 1.

In an embodiment, the pass-through connector 104 has a plug end 130 that engages the receptacle assembly 102. To mate with the receptacle assembly 102, the pass-through connector 104 is moved in a mating direction 114 such that the plug end 130 extends through the window 109 of the panel 110. The plug end 130 engages the receptacle assembly 102 in a covered space 132 that is defined between the panel 110 and the substrate 106. The pass-through connector 104 includes multiple transition contacts 118, and the receptacle assembly 102 includes multiple receptacle contacts 120. When the pass-through connector 104 mates to the receptacle assembly 102, the transition contacts 118 engage corresponding receptacle contacts 120 to electrically connect the pass-through connector 104 to the receptacle assembly 102 and provide signal pathways across the panel 110.

In the illustrated embodiment, the pass-through connector 104 also has a mating end 116 configured to mate with an auxiliary mating connector 122. The auxiliary mating connector 122 shown in FIG. 1 is terminated to a cable 124. The auxiliary mating connector 122 mates to the pass-through connector 104 in a mating direction 126. Mating contacts 128 in the auxiliary mating connector 122 engage the transition contacts 118 of the pass-through connector 104 when the connectors 104, 122 are mated to provide signal pathways through the connectors 104, 122.

Thus, in the illustrated embodiment, the pass-through connector 104 has two mating interfaces for removably coupling to two different connectors. For example, the pass-through connector 104 extends across the panel 110 and provides a transition or intermediary between the receptacle assembly 102 on one side of the panel 110 and the auxiliary mating connector 122 on the other side of the panel 110. The connectors 102, 104, 122 provide signal paths that allow sensors and other electrical devices within the panel 110 to communicate with processors, controllers, and other electrical devices remote from the panel 110, such as to relay status information from the device 108 or control orders or power to the device 108. In an alternative embodiment, the pass-through connector 104 may be terminated directly to a cable, a printed circuit board, or another electrical device.

Figure 2:
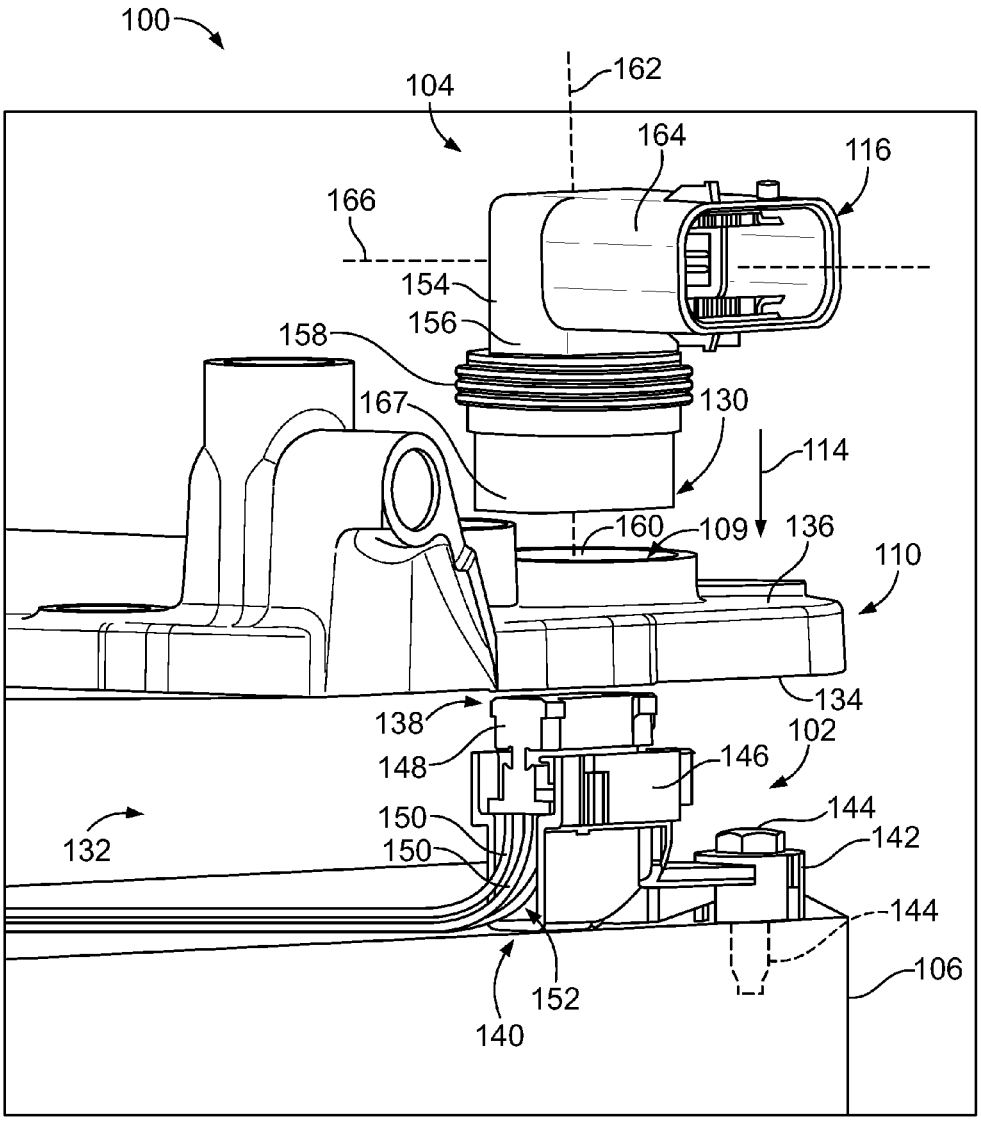
FIG. 2 is a front perspective view of the pass-through connector system according to an embodiment showing a pass-through connector poised for mating to a receptacle assembly.

FIG. 2 is a front perspective view of the pass-through connector system 100 according to an embodiment showing the pass-through connector 104 poised for mating to the receptacle assembly 102. The panel 110 is between the pass-through connector 104 and the receptacle assembly 102. The panel 110 has an interior side 134 and an opposite exterior side 136. The interior side 134 faces the substrate 106. The covered space 132 is defined between the substrate 106 and the interior side 134 of the panel 110. The exterior side 136 faces outward away from the substrate 106. The window 109 of the panel 110 extends through the panel 110 between the interior and exterior sides 134, 136. Although not shown in FIG. 2, the panel 110 may be mounted to the substrate 106.

The receptacle assembly 102 is mounted to the substrate 106 in the covered space 132. The receptacle assembly 102 extends between a mating end 138 and a mounting end 140. The mating end 138 is configured to engage the pass-through connector 104 during mating. The mounting end 140 abuts or is at least proximate to the substrate 106. The receptacle assembly 102 includes a mounting ear 142 at or proximate to the mounting end 140. The mounting ear 142 is used to mount the receptacle assembly 102 to the substrate 106. For example, the mounting ear 142 may receive a fastener 144 that couples the mounting ear 142 to the substrate 106. In the illustrated embodiment, the fastener 144 is a bolt. The fastener 144 extends through the mounting ear 142 and into the substrate 106. The receptacle assembly 102 may include more than one mounting ear 142 in other embodiments. The receptacle assembly 102 is mounted to the substrate 106 separately and independently from the panel 110. Due to separate mountings, it may be difficult to align the mating end 138 with the window 109 of the panel 110 in order to properly align with the pass-through connector 104 that extends through the window 109 during mating. Thus, in an exemplary embodiment, the receptacle assembly 102 is radially floatable relative to the substrate such that the receptacle assembly 102 can move to align with the window 109, as described in more detail herein.

In an embodiment, the receptacle assembly 102 includes a base 146 and a receptacle housing 148 that is mounted to the base 146. The receptacle housing 148 may be removably coupled to the base 146. The receptacle housing 148 may define the mating end 138, and the base 146 may define the mounting end 140. The mounting ear 142 may be integral to the base 146. The receptacle housing 148 is configured to hold receptacle contacts 120 (shown in FIG. 1) therein. The receptacle contacts 120 terminate to wires 150. The wires 150 extend from the receptacle housing 148 through the base 146. The wires 150 protrude from an orifice 152 in the base 146. The wires 150 extend to sensors, control circuitry, or other electrical devices within the interior of the panel 110. In an alternative embodiment, the receptacle housing 148 is integral with the base 146 instead of two discrete components.

The pass-through connector 104, in the unmated position shown in FIG. 2, is entirely outside of the covered space 132. The pass-through connector 104 is spaced apart from the exterior side 136 of the panel 110. The receptacle assembly 102, on the other hand, is disposed entirely within the covered space 132, and may be spaced apart from the interior side 134 of the panel 110. In an embodiment, to mate the pass-through connector 104 to the receptacle assembly 102, at least a portion of the pass-through connector 104 is loaded through the window 109 from the exterior side 136 towards the interior side 134 and into the covered space 132. In an embodiment, the portion of the pass-through connector 104 that enters the covered space 132 includes the plug end 130 of the connector 104. The plug end 130 engages the mating end 138 of the receptacle assembly 102. Thus, the pass-through connector 104 engages the receptacle assembly 102 in the covered space 132. The mating is a blind mating because it may be impossible or at least difficult for an operator located outside of the panel 110 to visually align the pass-through connector 104 with the receptacle assembly 102 for a coupling that occurs in the covered space 132.

The pass-through connector 104 has a body 154 that includes at least a first segment 156. The first segment 156 extends to and defines the plug end 130. Thus, at least part of the first segment 156 extends through the window 109 and into the covered space 132. In an embodiment, the pass-through connector 104 includes a compression seal 158 for sealing the body 154 to the panel 110 around the window 109. For example, the compression seal 158 may extend around a perimeter of the first segment 156. The compression seal 158 is configured to be received between the body 154 and edges 160 of the panel 110 that define the window 109 to seal the body 154 to the panel 110. For example, the compression seal 158 may fill gaps between the body 154 and the panel 110 that are present due to the window 109 being slightly larger than a cross-section of the first segment 156 of the body 154. The compression seal 158 may also compress in certain areas, applying a biasing force on the body 154 towards a center of the window 109.

In an embodiment, the first segment 156 of the body 154 extends generally along a first axis 162. In the illustrated orientation of the pass-through connector 104 in FIG. 2, the first axis 162 is parallel to the mating direction 114. In an exemplary embodiment, the body 154 further includes a second segment 164. The second segment 164 defines the mating end 116 of the pass-through connector 104 that is configured to mate with the auxiliary mating connector 122 (shown in FIG. 1). The second segment 164 extends from the first segment 156 to the mating end 116. The second segment 164 extends generally along a second axis 166. In the illustrated embodiment, the first segment 156 is orthogonal to the second segment 164 such that the first and second axes 162, 166 are approximately perpendicular to one another. Thus, the pass-through connector 104 is a right angle connector. For example, due to space constraints in the surrounding environment outside of the panel 110, it may be easier to mate and un-mate the auxiliary mating connector 122 to and from the pass-through connector 104 in directions that are generally parallel to the exterior side 136 of the panel 110, as opposed to mating perpendicular to the panel 110. The window 109 is not large enough to accommodate the second segment 164 of the pass-through connector 104 in the orientation shown in FIG. 2, so a separable interface between the pass-through connector 104 and the receptacle assembly 102 is provided in order to form a right angle signal path that extends through the panel 110. In other embodiments, the first and second segments 156, 164 of the pass-through connector 104 have other relative angles other than right angles, such as oblique angles or acute angles.

As described further herein, the pass-through connector 104 includes a shroud 167 at the plug end 130 that is configured to guide the mating end 138 of the receptacle assembly 102 into proper alignment with the pass-through connector 104 during the blind mating process. The receptacle assembly 102 is floatable radially relative to the substrate 106, which allows the receptacle assembly 102 to move, at least slightly, in response to the guidance from the shroud 167 to allow the receptacle assembly 102 to properly align with the pass-through connector 104. Optionally, the shroud 167 and/or mating end 138 of the receptacle assembly 102 may be tapered to provide the guidance. Proper alignment between the pass-through connector 104 and the receptacle assembly 102 allows the transition contacts 118 (shown in FIG. 1) to accurately engage corresponding receptacle contacts 120 (FIG. 1) to provide functioning signal paths across the panel 110.

Figure 3:
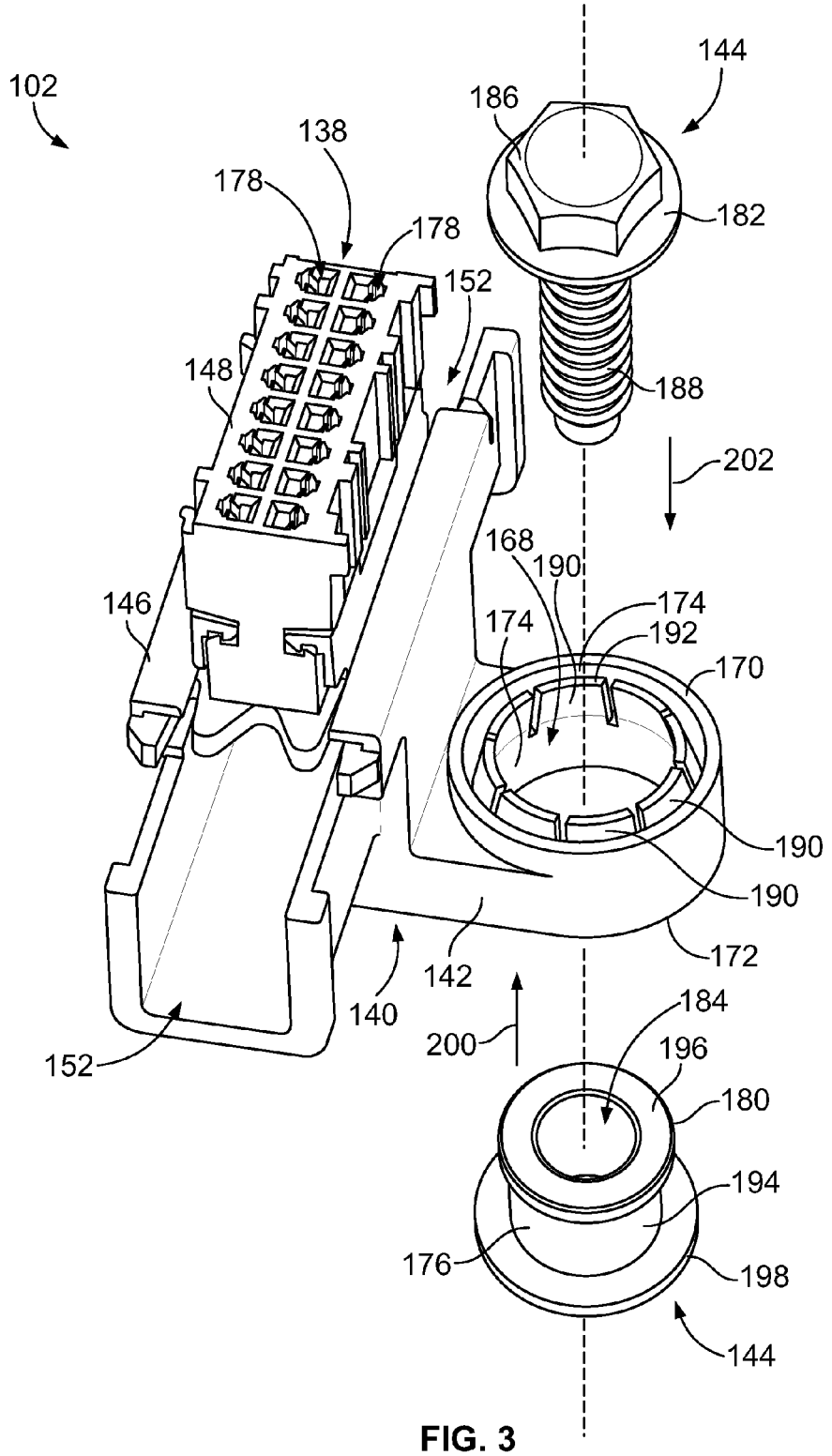
FIG. 3 is a partially-exploded perspective view of the receptacle assembly according to an embodiment.

FIG. 3 is a partially-exploded perspective view of the receptacle assembly 102 according to an embodiment. In FIG. 3, the receptacle housing 148 is coupled to the base 146, while the fastener 144 is spaced apart (for example, exploded) from the mounting ear 142. The receptacle housing 148 may be formed of an electrically insulating or dielectric material, such as a plastic material. The receptacle housing 148 defines multiple ports 178 open at the mating end 138. The ports 178 are configured to house the receptacle contacts 120 (shown in FIG. 1). Although not shown in FIG. 3, the receptacle housing 148 may be tapered towards the mating end 138 to facilitate a lead-in surface that is received in the plug end 130 (shown in FIG. 2) of the pass-through connector 104 during mating. For example, a cross-sectional area of the receptacle housing 148 at the mating end 138 may be less than a cross-sectional area of receptacle housing 148 more proximate to the mounting end 140 of the receptacle assembly 102.

The base 146 optionally may be formed of an electrically insulating or dielectric material, such as plastic. Alternatively, the base 146 may be at least partially composed of a conductive material, such as metal. The base 146 optionally may define two different orifices 152 for receiving and directing the wires 150 (shown in FIG. 2) that terminate to the receptacle contacts 120 (FIG. 1) in the receptacle housing 148. The two orifices 152 are located on opposite sides of the base 146.

The mounting ear 142 has an aperture 168 that extends through the ear 142 between a top 170 and a bottom 172 of the ear 142. The aperture 168 is defined by an inner surface 174 of the mounting ear 142. The fastener 144 is configured to be received in the aperture 168. In an embodiment, a diameter of the aperture 168 of the mounting ear 142 is greater than an outer diameter of the fastener 144 such that a gap 220 (shown in FIG. 4) forms between the inner surface 174 of the mounting ear 142 and an outer surface of the fastener 144. When the fastener 144 is coupled to the substrate 106 (shown in FIG. 1), the fastener 144 is fixed in place. The mounting ear 142, and the receptacle assembly 102 in general, is floatable radially within the gap 220 relative to the fastener 144. The floatability of the receptacle assembly 102 allows the receptacle assembly 102 to move, at least slightly, as the pass-through connector 104 is mated to the receptacle assembly 102 in order to properly align with the pass-through connector 104.

In an embodiment, the fastener 144 includes a bolt 182 and a bushing 180 that are both received in the aperture 168. The bushing 180 defines a channel 184, and the bolt 182 extends through the channel 184 to mechanically engage the substrate 106 (shown in FIG. 1). Thus, the bushing 180 surrounds at least a portion of the bolt 182. The outer surface 176 of the bushing 180 defines the outer surface of the fastener 144 (and the outer surface of the fastener 144 is referred to herein as "outer surface 176"). In an alternative embodiment, the bushing 180 may be integral to the bolt 182. In another alternative embodiment, the fastener 144 includes only the bolt 182 and no bushing. In the illustrated embodiment, the bolt 182 is a threaded bolt or screw. In alternative embodiments, the bolt 182 may be or include a pin bolt, a rivet, a latch, and/or the like. The bolt 182 includes a head 186 and a rod 188 extending from the head 186. The rod 188 may be at least partially threaded.

The mounting ear 142 includes a deflectable finger 190 that extends at least partially into the aperture 168 from the inner surface 174. A distal tip 192 of the deflectable finger 190 is configured to engage the fastener 144 to retain the fastener 144 within the aperture 168. The natural resting position of the distal tip 192 is extended into the aperture 168, but the deflectable finger 190 is deflectable outward towards the inner surface 174 of the mounting ear 142, such as when loading the fastener 144 in the aperture 168. In the illustrated embodiment, the mounting ear 142 includes a plurality of deflectable fingers 190 that are dispersed around a perimeter of the inner surface 174. The deflectable fingers 190 may be evenly spaced around the perimeter. Each finger 190 may be independently deflectable. In an alternative embodiment, the mounting ear 142 may have only a single deflectable finger 190 that optionally extends around an entire perimeter of the inner surface 174.

In an embodiment, the bushing 180 includes a stem 194 that extends between a first flange 196 and a second flange 198. For example, the stem 194 bridges the distance between and connects the first and second flanges 196, 198. The first and second flanges 196, 198 extend radially outward from the stem 194. The channel 184 of the bushing 180 extends through the length of the bushing 180. The bushing 180 may be formed of a metal material, a plastic material, or a combination of both. The bushing 180 may act as a compression limiter that absorbs compressive forces generated by tightening the bolt 182, thereby reducing the compressive forces applied to the mounting ear 142.

To assemble the receptacle assembly 102, the bushing 180 is loaded into the aperture 168 of the mounting ear 142. For example, the bushing 180 may be loaded from the bottom 172 of the mounting ear 142 towards the top 170 in a loading direction 200. As the bushing 180 is loaded, the first flange 196 engages the deflectable fingers 190 and deflects the fingers 190 outward. When the first flange 196 moves beyond (e.g., past) the fingers 190 in the loading direction 200, the fingers 190 are allowed to return to the natural resting position extended into the aperture 168. The bolt 182 is received in the channel 184 of the bushing 180. For example, the bolt 182 may be loaded into the channel 184 in an installation direction 202 that extends from the first flange 196 to the second flange 198. The installation direction 202 may be opposite to the loading direction 200. Optionally, the bushing 180 is loaded into the aperture 168 of the mounting ear 142 prior to the bolt 182 being installed through the channel 184 of the bushing 180.

Figure 4:
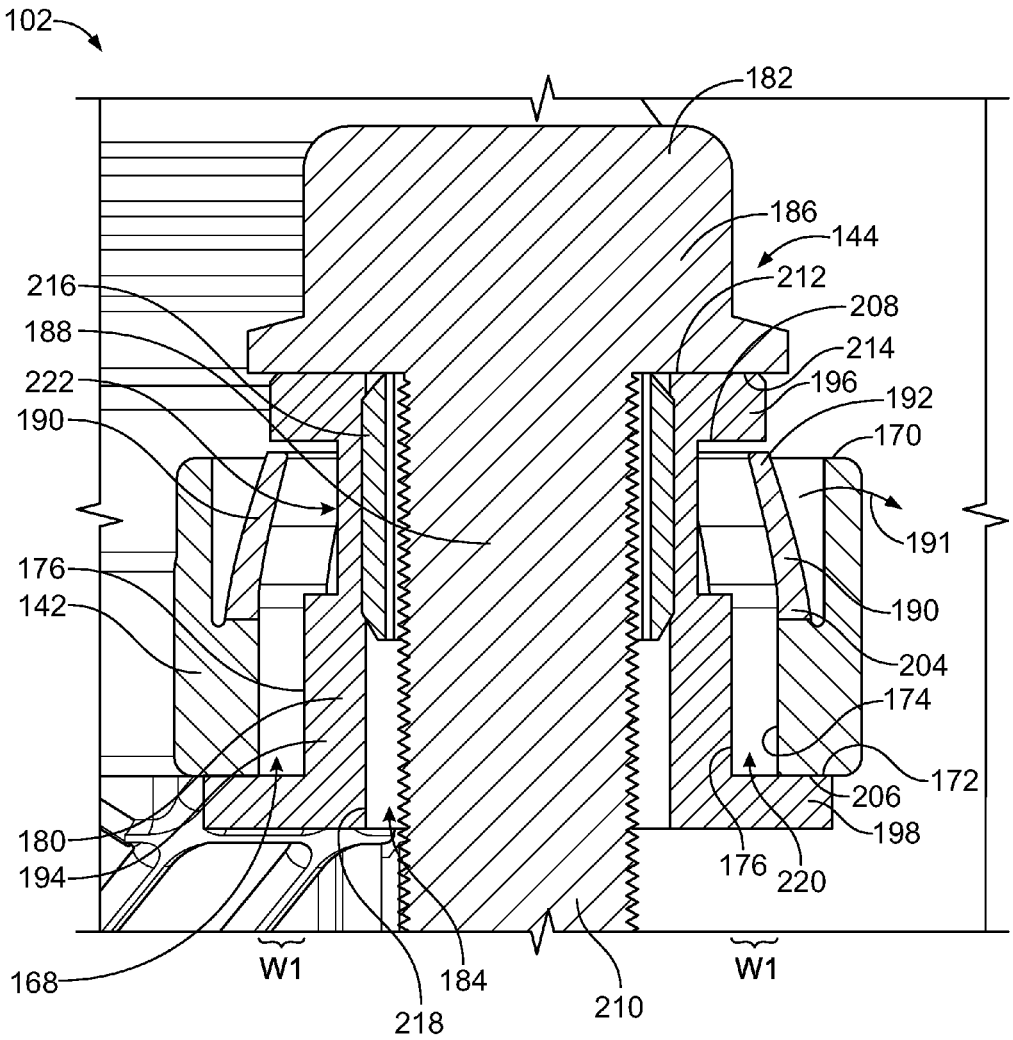
FIG. 4 is a cross-sectional view of a portion of the receptacle assembly that includes a mounting ear.

FIG. 4 is a cross-sectional view of a portion of the receptacle assembly 102 that includes the mounting ear 142. The one or more deflectable fingers 190 may be cantilevered from the inner surface 174 such that each finger 190 has a fixed end 204 at the inner surface 174 and the distal tip 192 at an opposite end. In an embodiment, the distal tips 192 are located proximate to the top 170 of the mounting ear 142. For example, the deflectable fingers 190 may extend both inward (towards the radial center of the aperture 168) and upward towards the top 170. When the bushing 180 is being loaded upwards in the loading direction 200 (shown in FIG. 3), the first flange 196 deflects the deflectable fingers 190 radially outward in an arc 191 about the fixed end 204 until the first flange 196 moves beyond the distal tips 192 and the deflectable fingers 190 are allowed to return to the natural resting positions. In FIG. 4, the bushing 180 is fully loaded within the mounting ear 142, such that the deflectable fingers 190 are axially between the first and second flanges 196, 198.

The bushing 180 is retained within the aperture 168 by the flanges 196, 198 engaging the mounting ear 142. For example, an inner surface 206 of the second flange 198 engages the bottom 172 of the mounting ear 142 to limit upward movement of the bushing 180 relative to the mounting ear 142. In an embodiment, the diameter of the first flange 196 is smaller than the diameter of the aperture 168, while the diameter of the second flange 198 is larger than the diameter of the aperture 168. Thus, the first flange 196 fits within the aperture 168 when the bushing 180 is being loaded, while the second flange 198 contacts the bottom 172 of the mounting ear 142 and is not permitted into the aperture 168. In an embodiment, upward movement of the mounting ear 142 relative to the bushing 180 is limited by the distal tips 192 of the deflectable fingers 190 engaging an inner surface 208 of the first flange 196. For example, when the deflectable fingers 190 are in the natural resting position, the distal tips 192 extend under the inner surface 208 of the first flange 196 and engage the inner surface 208 to restrict the mounting ear 142 from being pulled upwards off of the fastener 144. The inner surfaces 206, 208 of the first and second flanges 196, 198, respectively, are adjacent to the stem 194 and face towards one other.

The bolt 182 extends through the channel 184 of the bushing 180. A distal portion 210 of the rod 188 of the bolt 182 extends beyond the bottom 172 of the mounting ear 142 and beyond the second flange 198 of the bushing 180 to couple to the substrate 106 (shown in FIG. 1). A bottom surface 212 of the head 186 of the bolt 182 may be a bearing surface that engages an outer surface 214 of the first flange 196 to hold the bushing 180 against (or at least proximate to) the substrate 106. Thus, the bushing 180 may be sandwiched between the substrate 106 and the bottom surface 212 of the head 186, such that the bushing 180 is allowed little to no axial movement relative to the bolt 182. Optionally, a sleeve 216 may be disposed around the rod 188 of the bolt 182. The sleeve 216 may be formed of a compressive material, such as rubber or a rubber-like polymer. The sleeve 216 is configured to engage an interior surface 218 of the bushing 180 that defines the channel 184. In an embodiment, the sleeve 216 provides an interference fit between the bolt 182 and the bushing 180 such that the bushing 180 is allowed only negligible radial and/or rotational movement relative to the bolt 182.

In an exemplary embodiment, the diameter of the aperture 168 of the mounting ear 142 is greater than the diameter of the outer surface 176 of the fastener 144. For example, the diameter of the aperture 168 is greater than the outer diameter of the stem 194 of the bushing 180. As a result, a gap 220 is formed or defined between the inner surface 174 of the mounting ear 142 and the outer surface 176 of the stem 194. The gap 220 has an axial length that extends between the top 170 and the bottom 172 of the mounting ear 142. The gap 220 has a radial width that extends between the outer surface 176 of the stem 194 and the inner surface 174 of the mounting ear 142 (including the deflectable fingers 190). For example, the width W1 of the gap 220 that is illustrated in FIG. 4 represents the radial widths when the bushing 180 and the mounting ear 142 are concentric (for example, share a common axis). In the cross-section shown in FIG. 4, the width W1 of the gap 220 is approximately equal on both sides of the bushing 180.

The mounting ear 142 of the receptacle assembly 102 (shown in FIG. 1) is able to float radially within the gap 220 relative to the fastener 144 (for example, relative to both the bolt 182 and the bushing 180). The gap 220 has a radial width, so the mounting ear 142 is able to float radially in two dimensions along a plane. For example, in the cross-section shown in FIG. 4, the mounting ear 142 can float laterally left and right. Although not shown in FIG. 4, the mounting ear 142 can also float longitudinally frontward and backward relative to the fastener 144, and can float in vectors that have both lateral and longitudinal components. Thus, the mounting ear 142 may be floatable along the plane defined by lateral and longitudinal axes. Optionally, the mounting ear 142 is not floatable along a vertical (or elevation) axis towards and away from the substrate 106 (shown in FIG. 1). Optionally, the mounting ear 142 is floatable along the vertical axis, although only for small distances that are less than the available movement along the lateral-longitudinal plane defined by the lateral and longitudinal axes. For example, the mounting ear 142 may be floatable along the vertical axis for a distance that is a fraction of the floatable distance along the lateral-longitudinal plane, such as one-fourth or one-tenth.

From the position shown in FIG. 4, the receptacle assembly 102 (including the mounting ear 142) is permitted to float radially relative to the fastener 144 in any radial direction along the lateral-longitudinal plane for a distance that is no more than the width W1. Optionally, the width W1 may be a distance between 0.5 and 3 mm, such as 1 mm or 2 mm, for example. The maximum width of the gap 220 on a single side is no more than twice the width W1, which occurs when a portion of the inner surface 174 of the mounting ear 142 engages the outer surface 176 of the fastener 144. The receptacle assembly 102 is configured for the mounting ear 142 to be retained between the flanges 196, 198 of the bushing 180 regardless of the radial location of the mounting ear 142 relative to the bushing 180. For example, even when the radial width of the gap 220 is maximized on one side, the mounting ear 142 is prohibited from being pulled upwards out of the bushing 180.

The stem 194 of the bushing 180 optionally defines a groove 222 that extends along a perimeter of the outer surface 176. The groove 222 is located across from the deflectable fingers 190. Since the deflectable fingers 190 extend inward towards the radial center of the aperture 168, the groove 222 reduces the diameter of the stem 194 that is proximate to the fingers 190 to retain the width of the gap 220 between the mounting ear 142 and the stem 194 of the bushing 180. The groove 222 may extend from the first flange 196 for a portion of the length of the stem 194 towards the second flange 198. Although not shown in FIG. 4, the groove 222 may have a slope along the length that complements the deflectable fingers 190, such that the distance between the outer surface 176 of the stem 194 and the mounting ear 142 may be relatively constant in an axial direction between the top 170 and the bottom 172 of the mounting ear 142. In an alternative embodiment, the diameter of the outer surface 176 is uniform along the length of the stem 194 and does not define the groove 222. In this alternative embodiment, the radial width of the gap 220 between the distal tips 192 of the deflectable fingers 190 and the stem 194 is less than the radial width of the gap 220 between the fixed ends 204 of the deflectable fingers 190 and the stem 194. But, the distal tips 192 of the deflectable fingers 190 are deflectable outwards, providing additional clearance for the mounting ear 142 to float relative to the bushing 180.

Figure 5:
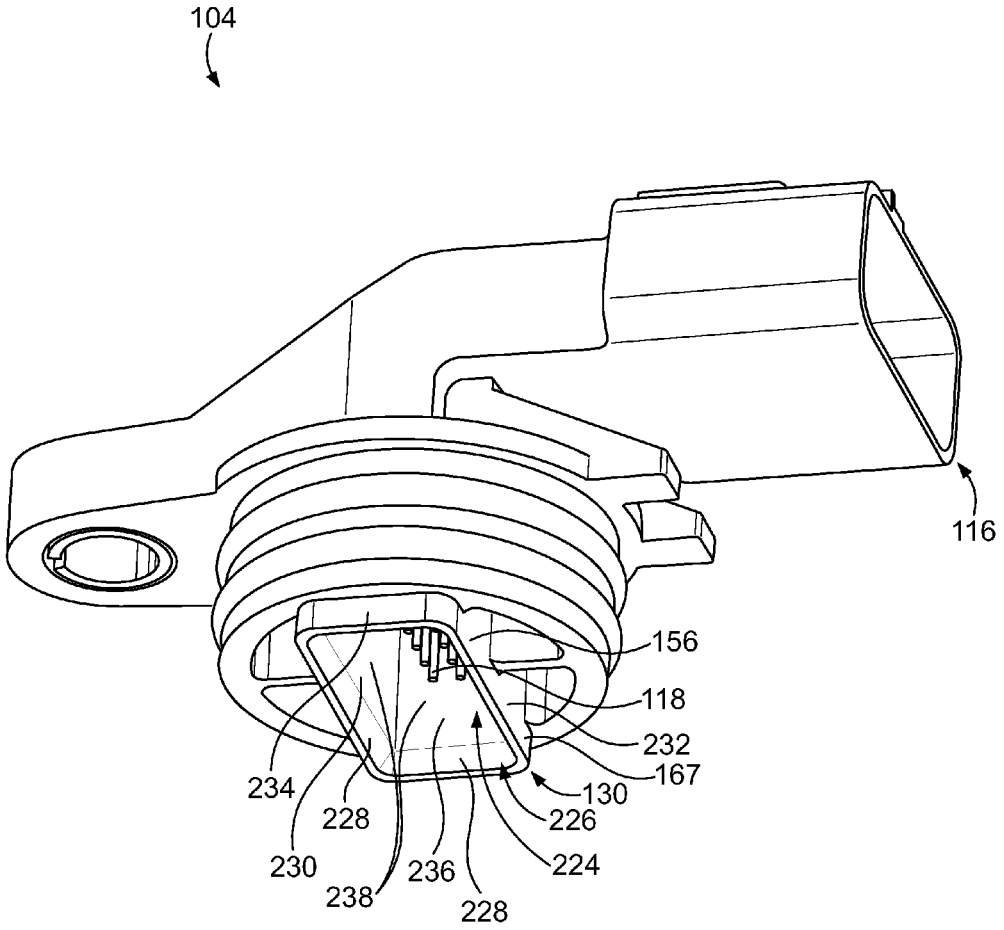
FIG. 5 is a bottom perspective view of the pass-through connector according to an embodiment.

FIG. 5 is a bottom perspective view of the pass-through connector 104 according to an embodiment. The pass-through connector 104 may be formed of an electrically insulating or dielectric material, such as a plastic material. The pass-through connector 104 defines a cavity 224 that extends between the plug end 130 and the mating end 116. The shroud 167 at the plug end 130 defines an opening 226 to the cavity 224. In an embodiment, the shroud 167 is configured to guide the mating end 138 (shown in FIG. 2) of the receptacle assembly 102 (FIG. 2) into the cavity 224. For example, the shroud 167 may include tapered lead-ins 228 that guide the mating end 138 radially towards a center of the cavity 224 in order to properly align with and engage the transition contacts 118 in the pass-through connector 104.

The shroud 167 is a portion of the first segment 156 of the pass-through connector 104. The shroud 167 includes a first side wall 230 and a second side wall 232 that extend to the plug end 130. The shroud 167 further includes a first end wall 234 and a second end wall 236 that extend to the plug end 130. The end walls 234, 236 extend between and connect the side walls 230, 232. In the illustrated embodiment, the shroud 167 has tapered lead-ins 228 that extend along each of the side walls 230, 232 and along each of the end walls 234, 236. The tapered lead-ins 228 extend between a non-tapered portion 238 of the respective walls 230-236 and the plug end 130. The tapered lead-ins 228 decrease in thickness in an axial direction from the non-tapered portions 238 towards the plug end 130. For example, a cross-sectional area of the cavity 224 defined between the non-tapered portions 238 of the walls 230-236 is less than the cross-sectional area of the cavity 224 in a plane through the tapered lead-ins 228. In alternative embodiments, the tapered lead-ins 228 may be located on the side walls 230, 232 only, on the end walls 234, 236 only, or not on any of the walls 230-236 (such as if the mating end 138 of the receptacle assembly 102 is tapered).

Figure 6:
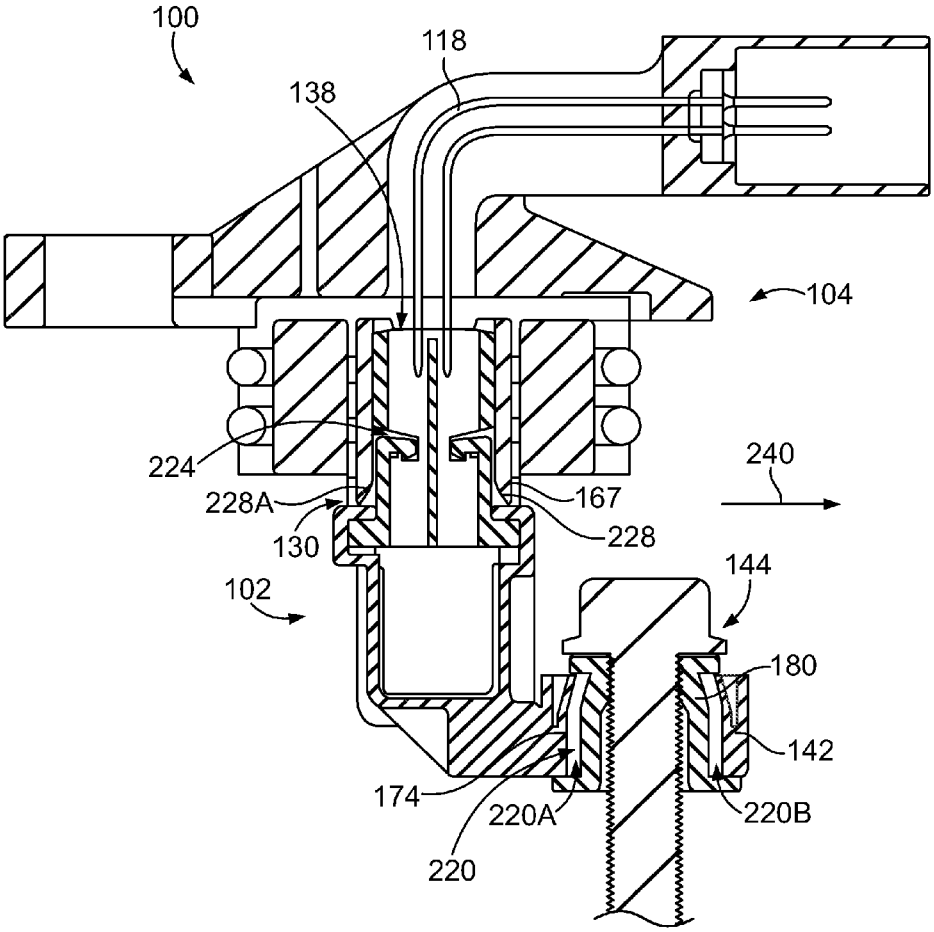
FIG. 6 is a cross-sectional view of the pass-through connector system showing the pass-through connector mated to the receptacle assembly.

FIG. 6 is a cross-sectional view of the pass-through connector system 100 showing the pass-through connector 104 mated to the receptacle assembly 102. Neither the panel 110 (shown in FIG. 2) nor the substrate 106 (FIG. 2) are shown in FIG. 6. During mating, when the plug end 130 of the pass-through connector 104 is loaded through the window 109 (shown in FIG. 2) of the panel 110 into the covered space 132 (FIG. 2), the plug end 130 engages the mating end 138 of the receptacle assembly 102. The plug end 130 may not be properly aligned with the mating end 138 at first engagement. For example, since the receptacle assembly 102 may not be directly coupled to the panel 110, and the receptacle assembly 102 and the panel 110 may be separately mounted to the substrate 106, the mating end 138 may not properly align with the window 109 of the panel 110. In addition, the mating between the pass-through connector 104 and the receptacle assembly 102 is blind, so visual alignment may be impossible.

In an exemplary embodiment, at least one of the shroud 167 or the mating end 138 includes tapered surfaces for guidance. In the illustrated embodiment, the shroud 167 of the pass-through connector 104 includes tapered lead-ins 228 at the plug end 130. As the plug end 130 is loaded onto the mating end 138, the lead-ins 228 guide the mating end 138 into the cavity 224 such that the mating end 138 is centered (or at least in proper alignment so the receptacle contacts 120 (shown in FIG. 1) engage the corresponding transition contacts 118). The gap 220 between the fastener 144 (for example, the bushing 180 of the fastener 144) and the inner surface 174 of the mounting ear 142 allows the receptacle assembly 102 to float radially. For example, the receptacle assembly 102 may be floatable radially in a plane that is parallel to a mounting surface of the substrate 106 (shown in FIG. 2) to which the receptacle assembly 102 is mounted. Thus, as the mating end 138 of the receptacle assembly 102 engages the lead-ins 228 of the pass-through connector 104, the gap 220 in the mounting ear 142 allows the receptacle assembly 102 to be moved in the direction that the lead-ins 228 guide the mating end 138, such that the mating end 138 properly aligns with the pass-through connector 104.

For example, if the mating end 138 is misaligned and too far to the left upon engaging the plug end 130 of the pass-through connector 104, the left lead-in 228A forces the mating end 138 to the right as the pass-through connector 104 mates with the receptacle assembly 102. The receptacle assembly 102 floats in a rightward direction 240 to accommodate the force applied on the mating end 138 by the lead-in 228A. Since the fastener 144 is fixed in place, as the mounting ear 142 moves in the rightward direction 240 the width of the left gap 220A on the left side of the fastener 144 decreases, while the width of the right gap 220B on the right side of the fastener 144 increases. The left and right gaps 220A, 220B are both sections of the gap 220 that extends around the perimeter of the fastener 144. Due to the tapered lead-ins 228 and the floatable receptacle assembly 102, the pass-through connector 104 aligns properly with the receptacle assembly 102 during the blind mating process to provide a signal path across the panel 110.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A pass-through connector system comprising:

a receptacle assembly extending between a mating end and a mounting end, the receptacle assembly having a mounting ear at least proximate to the mounting end, the mounting ear defining an aperture therethrough, the receptacle assembly further including a fastener received in the aperture that is configured to be coupled to a substrate to mount the receptacle assembly to the substrate, a diameter of the aperture of the mounting ear being greater than an outer diameter of the fastener such that a gap is formed between an inner surface of the mounting ear and an outer surface of the fastener; and a pass-through connector having a plug end configured to extend through a window in a panel that at least partially surrounds the substrate to mate to the mating end of the receptacle assembly, the pass-through connector defining a cavity that has an opening at the plug end, the pass-through connector having a shroud at the plug end that guides the mating end of the receptacle assembly through the opening into the cavity;

wherein the receptacle assembly is floatable radially within the gap relative to the fastener to allow the shroud of the pass-through connector to move the receptacle assembly into alignment with the cavity of the pass-through connector during mating.

2. The pass-through connector system of claim 1, wherein the receptacle assembly is mounted to the substrate and located in a covered space between the substrate and an interior side of the panel, at least a portion of the pass-through connector extending through the window from an exterior side of the panel such that the plug end of the pass-through connector mates to the receptacle assembly in the covered space.

3. The pass-through connector system of claim 1, wherein the pass-through connector has a body including a first segment that extends to the plug end and a second segment that extends to a mating end configured to mate with an auxiliary mating connector, the first segment extending generally orthogonal to the second segment.

4. The pass-through connector system of claim 1, wherein the receptacle assembly includes a base and a receptacle housing mounted to the base, the mounting ear being integral to the base, the receptacle housing holding receptacle contacts therein, the receptacle contacts terminating to wires, the wires extending from the receptacle housing through the base and protruding from an orifice in the base.

5. The pass-through connector system of claim 1, wherein the pass-through connector has a body including at least a first segment, the first segment extending to the plug end, the pass-through connector including a compression seal disposed around a perimeter of the first segment, the compression seal being disposed between the body and edges of the panel defining the window and configured to seal the pass-through connector to the panel.

6. The pass-through connector system of claim 1, wherein the mounting ear includes a plurality of deflectable fingers dispersed around a perimeter of the inner surface that defines the aperture, the deflectable fingers extending into the aperture from the inner surface, distal tips of the deflectable fingers configured to engage a flange of the fastener to retain the fastener within the aperture.

7. The pass-through connector system of claim 1, wherein the fastener comprises a bolt and a bushing that surrounds the bolt, the bushing having a stem defined between a first flange and a second flange, the first and second flanges extending radially outward from the stem, the first flange configured to engage at least one deflectable finger of the mounting ear that extends into the aperture and the second flange configured to engage a bottom of the mounting ear to retain the bushing in the aperture.

8. The pass-through connector system of claim 1, wherein the shroud of the pass-through connector has first and second side walls and first and second end walls that extend between the first and second side walls, the shroud including tapered lead-ins at the plug end that extend along each of the first and second side walls and the first and second end walls to guide the mating end of the receptacle assembly radially towards a center of the cavity during mating.

9. The pass-through connector system of claim 1, wherein the receptacle assembly is radially floatable in two dimensions along a plane.

10. The pass-through connector system of claim 1, wherein the receptacle assembly is tapered towards the mating end such that a cross-sectional area of the receptacle assembly at the mating end is less than a cross-sectional area of the receptacle assembly more proximate to the mounting end.

11. A pass-through connector system comprising:

a panel coupled to and at least partially surrounding a substrate, the panel spaced apart from the substrate and defining a covered space therebetween, the panel defining a window through the panel into the covered space;

a receptacle assembly mounted to the substrate and located in the covered space, the receptacle assembly extending between a mating end and a mounting end, the receptacle assembly having a mounting ear at least proximate to the mounting end, the mounting ear defining an aperture therethrough, the receptacle assembly further including a fastener received in the aperture that is coupled to the substrate to mount the receptacle assembly to the substrate, a diameter of the aperture of the mounting ear being greater than an outer diameter of the fastener such that a gap is formed between an inner surface of the mounting ear and an outer surface of the fastener, the receptacle assembly being floatable radially within the gap relative to the fastener; and a pass-through connector extending through the window of the panel, the pass-through connector having a plug end within the covered space that is mated to the mating end of the receptacle assembly, the pass-through connector defining a cavity that has an opening at the plug end, the pass-through connector having a shroud at the plug end that guides the mating end of the floatable receptacle assembly through the opening into the cavity during mating.

12. The pass-through connector system of claim 11, wherein the fastener comprises a bushing and a bolt, the bolt extending through a channel in the bushing and mechanically engaging the substrate, the bushing defining the outer surface of the fastener.

13. The pass-through connector system of claim 12, wherein the bushing has a stem that is defined between a first flange and a second flange, the first and second flanges extending radially outward from the stem, the first flange configured to engage at least one deflectable finger of the mounting ear that extends into the aperture and the second flange configured to engage a bottom of the mounting ear to retain the bushing in the aperture.

14. The pass-through connector system of claim 11, wherein the receptacle assembly is separately mounted to the substrate from the panel such that both the fastener and the panel are independently fixed relative to the substrate, the receptacle assembly being radially floatable to align with the window of the panel and the pass-through connector that is loaded therethrough.

15. The pass-through connector system of claim 11, wherein the covered space is defined by an interior side of the panel, at least a portion of the pass-through connector extending through the window from an exterior side 136 of the panel such that the plug end of the pass-through connector mates to the receptacle assembly in the covered space.

16. The pass-through connector system of claim 11, wherein the pass-through connector has a body including a first segment that extends to the plug end and a second segment that extends to a mating end configured to mate with an auxiliary mating connector, the first segment extending generally orthogonal to the second segment.

17. The pass-through connector system of claim 11, wherein the receptacle assembly includes a base and a receptacle housing mounted to the base, the mounting ear being integral to the base, the receptacle housing holding receptacle contacts therein, the receptacle contacts terminating to wires, the wires extending from the receptacle housing through the base and protruding from an orifice in the base.

18. The pass-through connector system of claim 11, wherein the pass-through connector has a body including at least a first segment, the first segment extending to the plug end, the pass-through connector including a compression seal disposed around a perimeter of the first segment, the compression seal being disposed between the body and edges of the panel defining the window and configured to seal the pass-through connector to the panel.

19. The pass-through connector system of claim 11, wherein the receptacle assembly is radially floatable in two dimensions along a plane.

20. The pass-through connector system of claim 11, wherein the shroud of the pass-through connector has first and second side walls and first and second end walls that extend between the first and second side walls, the shroud including tapered lead-ins at the plug end that extend along each of the first and second side walls and the first and second end walls to guide the mating end of the receptacle assembly radially towards a center of the cavity during mating.

* * * * *